US007624839B1

(12) United States Patent
Graber

(10) Patent No.: US 7,624,839 B1
(45) Date of Patent: Dec. 1, 2009

(54) ENCLOSURE FOR SYMBIOTIC ACTIVE/PASSIVE OPERATION OF AN ACOUSTIC DRIVER

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 184 days.

(21) Appl. No.: 11/433,472

(22) Filed: May 12, 2006

(51) Int. Cl.
*H04R 1/28* (2006.01)

(52) U.S. Cl. ..... 181/156; 181/145; 181/148; 181/152; 181/199; 381/335; 381/349; 381/351

(58) Field of Classification Search ..... 181/148, 181/152, 156, 198, 199, 147, 145; 381/335, 381/345, 346, 349, 351, 71.1
See application file for complete search history.

(56) References Cited

U.S. PATENT DOCUMENTS

| | | | | |
|---|---|---|---|---|
| 4,206,830 | A | 6/1980 | Sohma et al. | |
| 4,437,540 | A * | 3/1984 | Murakami et al. | 181/147 |
| 4,924,963 | A * | 5/1990 | Polk | 181/144 |
| 5,204,501 | A * | 4/1993 | Tsao | 181/156 |
| 5,258,584 | A * | 11/1993 | Hubbard | 181/147 |
| 5,317,642 | A * | 5/1994 | Danley et al. | 381/182 |
| 5,432,860 | A | 7/1995 | Kasajima et al. | |
| 5,629,502 | A * | 5/1997 | Nakano | 181/156 |
| 5,809,153 | A * | 9/1998 | Aylward et al. | 381/337 |
| 5,898,138 | A * | 4/1999 | Delgado, Jr. | 181/152 |
| 5,925,856 | A * | 7/1999 | Meyer et al. | 181/152 |
| 6,169,811 | B1 * | 1/2001 | Croft, III | 381/186 |
| 6,176,345 | B1 | 1/2001 | Perkins et al. | |
| 6,411,718 | B1 | 6/2002 | Danley et al. | |
| 6,504,938 | B1 * | 1/2003 | Anderson et al. | 381/335 |
| 6,658,129 | B2 | 12/2003 | D'Hoogh | |
| 6,704,426 | B2 * | 3/2004 | Croft, III | 381/351 |
| 6,760,462 | B1 * | 7/2004 | Thigpen | 381/431 |
| 6,782,112 | B1 * | 8/2004 | Geddes | 381/351 |
| 6,886,658 | B1 * | 5/2005 | Rolph | 181/199 |
| 2002/0061114 | A1 * | 5/2002 | Croft, III | 381/345 |
| 2005/0169488 | A1 * | 8/2005 | Kato et al. | 381/98 |
| 2005/0180577 | A1 * | 8/2005 | Horbach | 381/27 |

* cited by examiner

*Primary Examiner*—Jeremy Luks
(74) *Attorney, Agent, or Firm*—Paul W. O'Malley; Susan L. Firestone

(57) ABSTRACT

A compact loudspeaker enclosure combines planar type devices for high frequency sound reproduction and cone type active devices for low frequency sound reproduction. The low frequency cone type transducers are mounted in baffles between forward and rear enclosed spaces and thus do not directly radiate into the environment. The first enclosed space is acoustically coupled to the environment by the planar device which is mounted between the first enclosed space and the environment with one major face mounted to radiate either directly into the environment or to be horn loaded. The planar operates as a passive radiator to the LF devices at low frequencies and an active device above a crossover frequency.

13 Claims, 9 Drawing Sheets

ENCLOSURE FOR SYMBIOTIC ACTIVE/PASSIVE OPERATION OF AN ACOUSTIC DRIVER

BACKGROUND OF THE INVENTION

1. Technical Field

The invention relates to loudspeaker enclosures having active and passive radiating elements, and more particularly, an enclosure providing a class of radiating elements which operates in both an active mode and in a passive mode.

2. Description of the Problem

Compactness is a desirable feature in loudspeaker enclosures for many applications. Full range acoustic reproduction is also desirable especially for the reproduction of music. But achieving these objectives in a common package poses challenges to the sound system designer.

One starting point in the design of a loudspeaker system is the basic bass-reflex enclosure. A bass-reflex enclosure is a closed box in which a loudspeaker has been mounted to directly radiate into the environment. The interior of the enclosure behind the loudspeaker is ported to the environment. Enclosures are ported to accommodate a varying volume of air in the enclosure. Air escapes or enters the enclosure through the port as a function of varying air pressure in the enclosure produced by the oscillating diaphragm of the cone. The port operates as a sort of second diaphragm driven by the backside of the diaphragm of the active device. A problem with ports is that they can require a substantial area to function properly. As area increases the longer the vent connecting the enclosure to the mouth of the port is required to be. At some expense ports can be effectively replaced with passive radiators, such as so called drone cones.

Passive radiators have been commercially known since the mid 1950's. Passive radiators have typically been constructed as an analogue of cone loudspeakers, that is, they have been based on a cone suspended in a baffle by a suspension or "compliance". Typically they have radiated directly to the environment. Mass is added to the cone or diaphragm as desired for tuning, but no voice coil is used to drive it, another active radiator being used for that purpose. A passive radiator is typically mounted over a sealed enclosure, providing an efficient and compact replacement of a port.

Passive radiators replace the mass and stiffness of the air in a ported loudspeaker enclosure with its mechanical equivalent over a sealed enclosure. Passive radiators substantially reduce the required volume for an enclosure to obtain equivalent tuning to a port. In part this is because air velocity (and noise through a port) is eliminated. Passive radiators thus allow a smaller speaker enclosure to be used. At low frequencies this produces a substantial absolute reduction in the size of the volume of the enclosure. Also at low frequencies a passive radiator diaphragm moves in response to pressure variations in a sealed speaker enclosure in a manner similar to movement of a mass of air through the port in a ported system, but without the potential for frictional noise resulting from the movement of air into and out the port.

A full range loudspeaker system must address high frequency as well as low frequency sound reproduction. One way of addressing the need for a high frequency source is the use of so-called planar or ribbon devices. Planar/ribbon type transducers are, in effect, a line array of infinitesimal elements positioned directly adjacent one another, i.e. a line array having zero spacing between mutually coupled drivers. This in turn means that a planar has no practical upper frequency limit in the human audio range. Planar type devices have not been considered suitable for low frequency audio reproduction.

SUMMARY OF THE INVENTION

According to the invention a compact loudspeaker enclosure combining planar type active devices for high frequency sound reproduction and cone type active devices for low frequency sound reproduction is taught. Advantageously, low frequency cone type transducers are mounted in baffles between first and second enclosed chambers and thus do not directly radiate into the environment. The first or common enclosed chamber is acoustically coupled to the environment by a planar device which is mounted between the first enclosed space and the environment with one major face being horn loaded or freely radiating into the environment. The remaining major face of the planar faces the common chamber. The planar operates as a passive radiator at low frequencies for the low frequency devices and in an active mode for high frequencies. The loudspeaker enclosure appears from the outside as a mounting arrangement for a planar/ribbon with no visible low frequency unit.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

The loudspeaker system of the invention includes embodiments incorporating waveguides and those which do not. Performance of representative systems is illustrated graphically. In all embodiments a planar type device is preferred in the role of a high frequency active compont and low frequency passive component. The high frequency audio range is taken to be 275 hz-20 khz and the low frequency range is approximately 80 hz-275 hz with the cross over frequency occurring at about 275 hz.

In overview, the invention provides low frequency cone type transducers which work in a 4th order passband, acoustic, multi-chamber enclosure with a tuned rear chamber of air behind the cones and a tuned common chamber behind the passive low frequency/active high frequency radiator. The dual mode radiator is preferably based on a planar device which operates an active element above the crossover point. The relative volume of the rear to front chamber is in nominal ratio of 2.75:1. Depending upon system requirements this ratio may be adjusted.

A planar device is preferred for providing multiple mode operation in all embodiments, but it is possible to design a workable system using any pistonic device such as a large format dome or even a compression loaded diaphragm for the multiple mode device. In all cases though the front radiating device is active across the majority of its bandwidth and acts passively over a low frequency bandwidth. The arrangement extends the useable frequency response of the high frequency device an octave or more lower. Where a planar device is used it works best in performance terms to have a bi-laterally tensioned yet mechanically compliant diaphragm. However a non-tensioned diaphragm solution can be used to allow for a simpler in field service arrangement. For the planar arrangements the circuit topology is shown only with a double sided (magnets in push pull) arrangement but other arrangements including single sided, asymmetrical double sided and other bar magnet topologies could be produced with good results.

Figure 1:
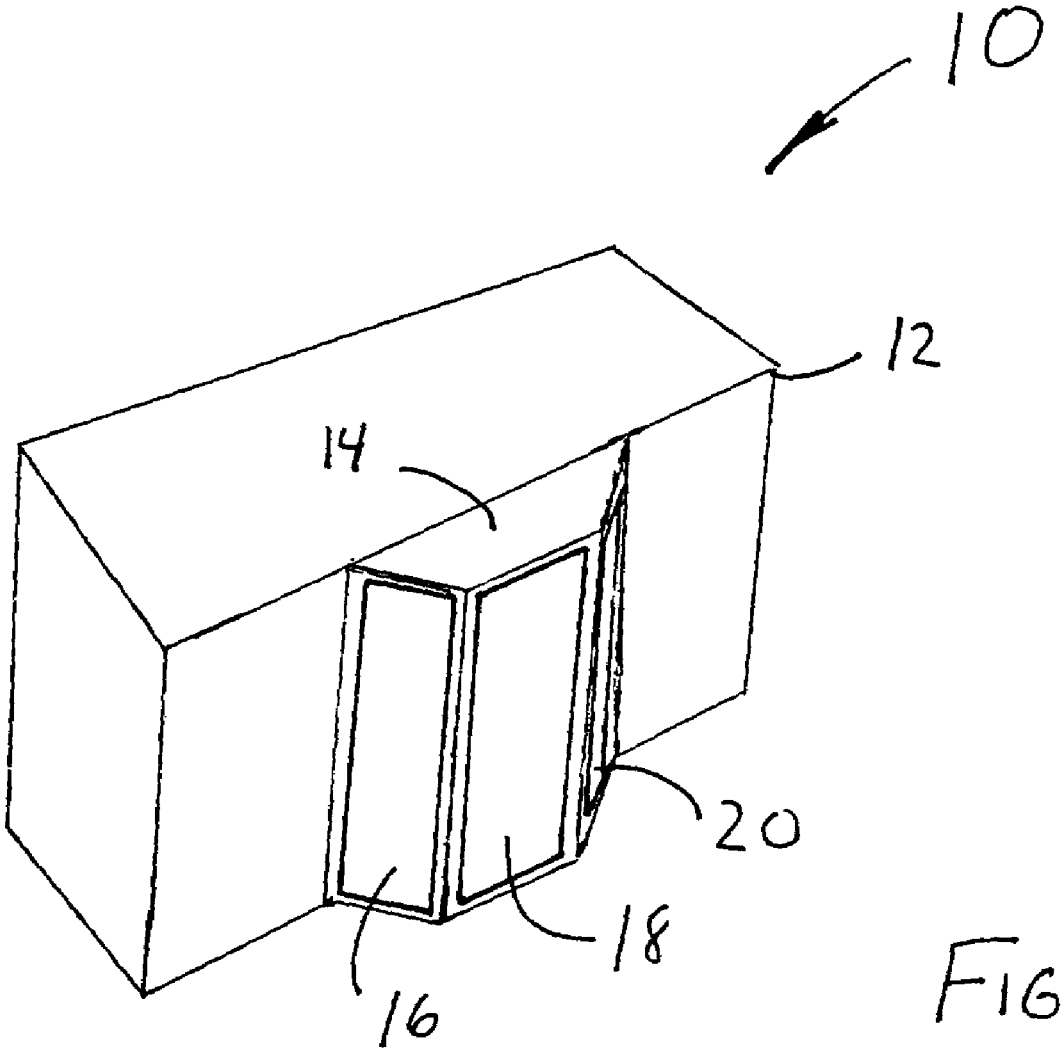
FIG. 1 is a perspective view of a loudspeaker enclosure incorporating the inventive arrangement of loudspeaker transducers.

Referring now to FIG. 1, a loudspeaker system 10 is based on an enclosure 12. Low frequency loudspeakers (not shown) are mounted within enclosure 12 and are not visible from the outside of the enclosure. Nor is there any apparent grating or outlet of the low frequency loud speakers. On the exterior of enclosure 12, set in three sides of a trapezoidal projection 14, are planer acoustic transducers 16, 18, 20.

Figure 2:
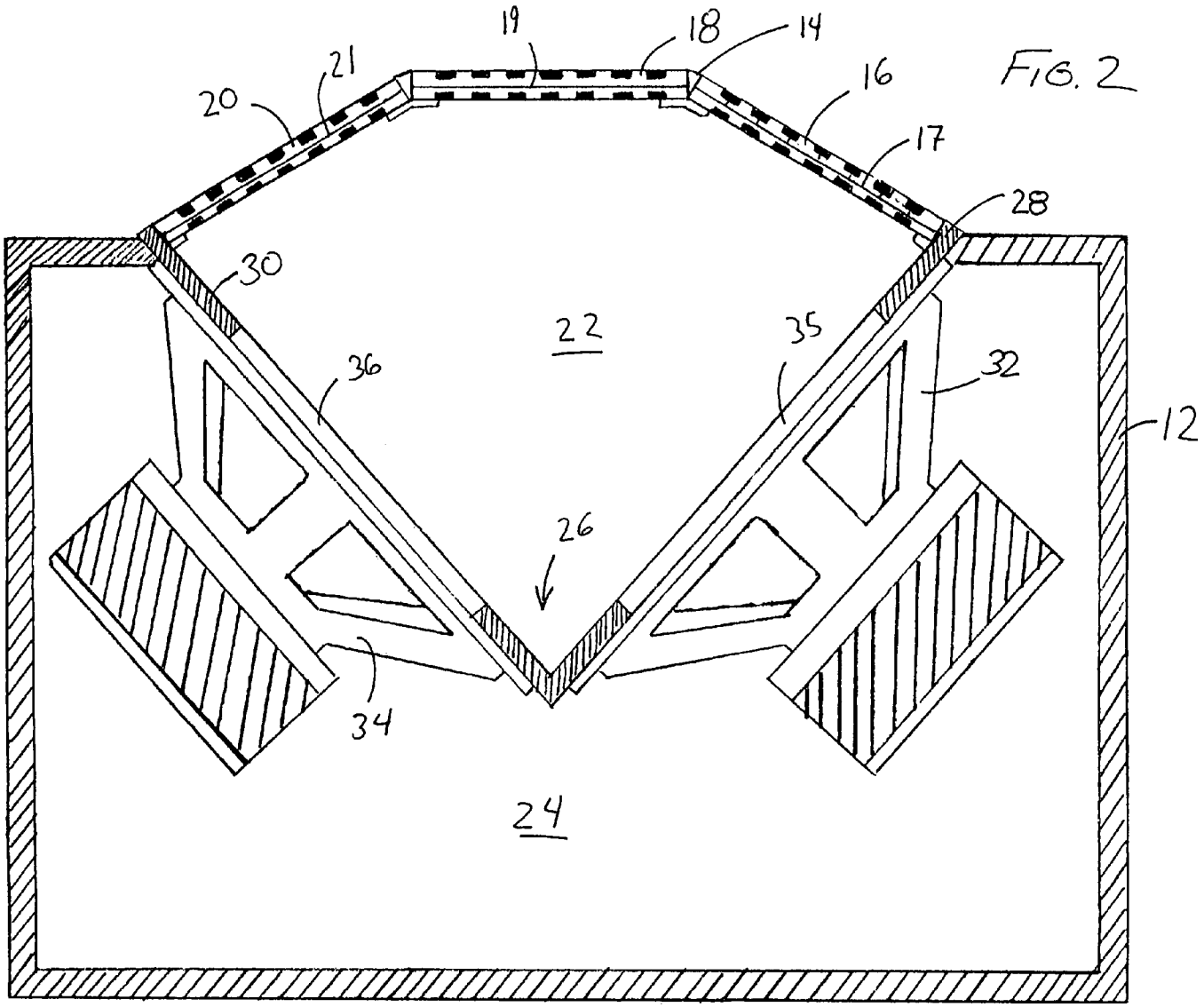
FIG. 2 is a cross-sectional view of a first embodiment of the invention.

Referring to FIG. 2 the enclosure 12 of FIG. 1 is shown in horizontal cross section. Basic to the layout of enclosure 12 is division of the interior space of enclosure 12 into first and second sealed chambers 22, 24. First and second sealed chambers 22, 24 are separated by an internal V-shaped baffle 26 formed from semi-baffles 28 and 30. The front or common sealed chamber is tuned to the planar transducers 16, 18, 20 set across the front face of enclosure 12. The second or rear chamber is tuned to a pair of conventional cone type loudspeakers 32, 34, mounted in semi-baffles 28, 30, respectively. In all embodiments arrays of loudspeakers may be vertically stacked.

Pairs of loudspeakers 32, 34 are mounted behind semi-baffles 28, 30 and set to cooperatively radiate into chamber 22. These devices are relatively low frequency devices, and in the preferred embodiments have a predominant operational range from about 80 hz to 275 hz. They are mounted to the back of semi-baffle 28, 30 to radiate through apertures 35, 36. The low frequency cone loudspeakers 32, 34 function as a fourth order passband acoustic multi-chamber enclosure with the tuned rear volume/chamber 24. Semi-baffles 32, 34 are set at an angle whereby the centerlines of pairs of LF transducers 32, 34 intersect well behind the diaphragm of the planar transducers 16, 18, 20. Output from the LF loudspeakers 32, 34 should exhibit unitary summation and wavefronts hitting the back of the planars 16, 18, 20 should be coherent.

Figure 7:
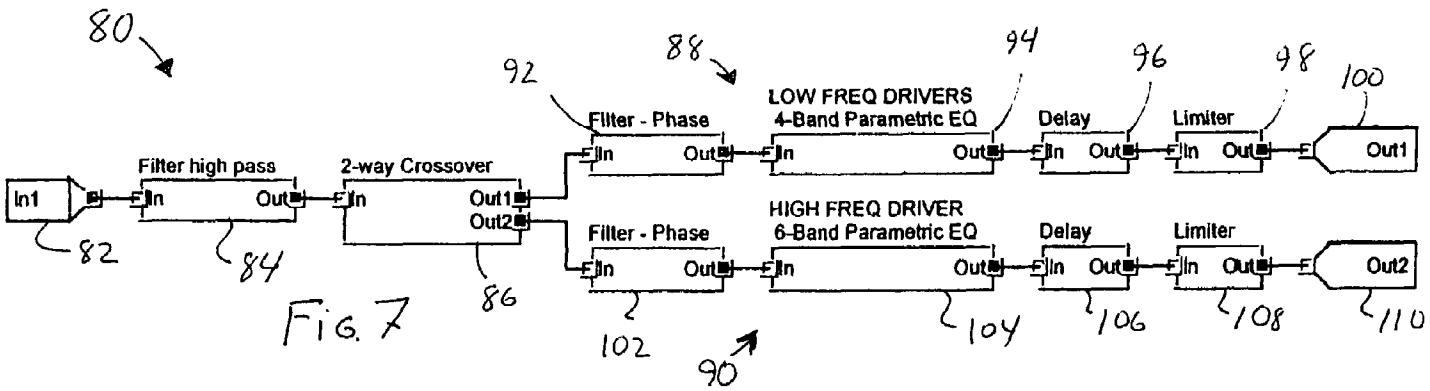
FIG. 7 is a block diagram schematic of drive circuitry for any of the embodiments.

Planars 16, 18 and 20, operate as active devices in an upper frequency range from 275 hz to 20 Khz and predominantly as passive devices below 275 hz. Thus diaphragms 17, 19, 21 of planars 16, 18, 20 operate as passive radiators to loudspeakers 32, 34 in the dominant frequency range of the LF loudspeakers. Careful attention must be given to bi-lateral tensioning of diaphragms 16, 18 and 20 while preserving a high degree of compliance for the best results. Use of a non-tensioned diaphragm may work, but at a cost of performance. However a unit incorporating an untensioned diaphragm may be desirable for ease of field maintenance. Planar devices 16, 18, 20 operate as both active and passive devices cooperating with a tuned common volume/chamber 22. At the preferred frequency crossover of 275 hz the relative volume of the rear chamber to the common chamber is 2.75 to 1.00. Planar devices 16, 18 and 20 are illustrated using a push pull configuration, however other configurations are possible. For the three planar array illustrated in FIGS. 1 and 2 there exists an acoustic point of origin in sealed common chamber 22 which serves as a timing point to produce an isophasic and coherent wavefront of the sum of the outputs of the driver elements including passively radiated energy. Electrical circuitry suitable for operating the device is shown in FIG. 7.

The shape of the rear chamber 24, or more precisely, the relative orientation of its interior surfaces relative to the loudspeakers 32, 34, functions to kill standing waves. To avoid generation of standing waves the interior walls should not be parallel to the backs of loudspeakers 32, 34 but have an oblique orientation thereto. Similarly the semi-baffles 28, 30 are set at oblique angles relative to the back major faces of diaphragms 17, 19 and 21 of planars 16, 18 and 20.

Figure 3:
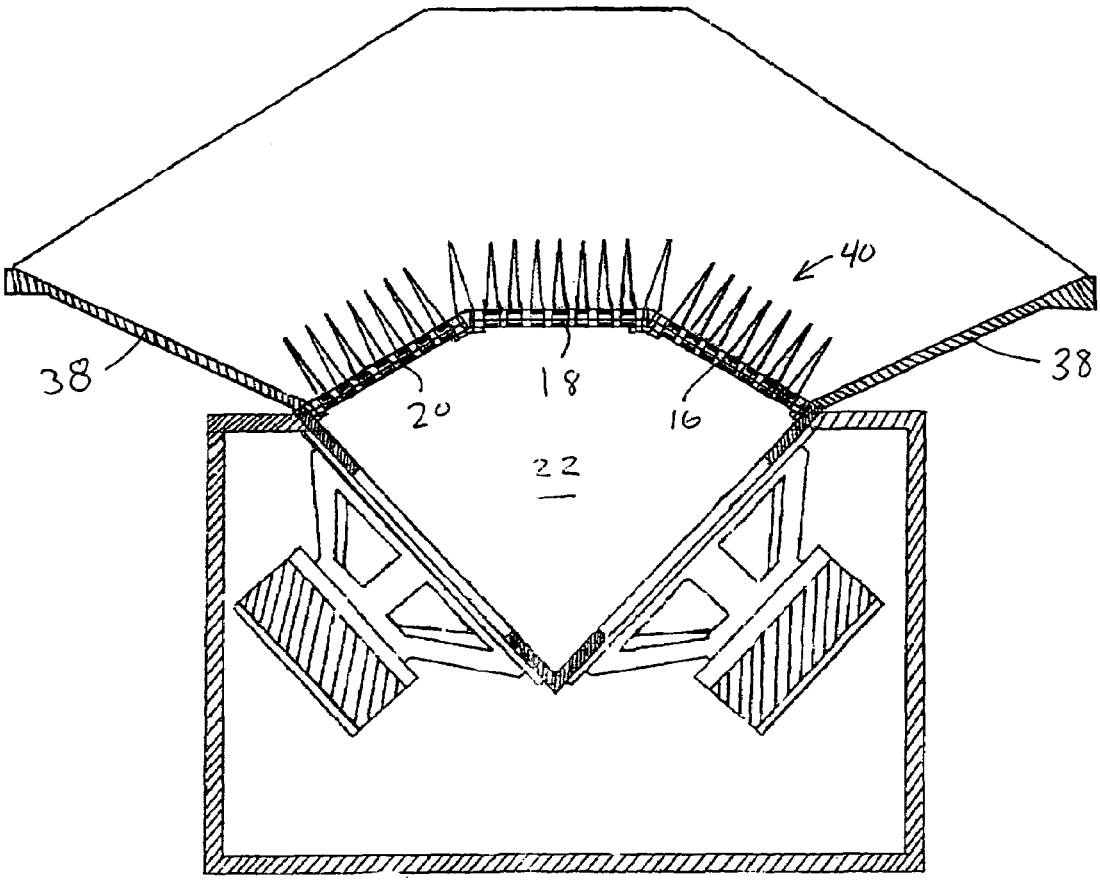
FIG. 3 is a cross sectional view of a second embodiment of the invention.

FIG. 3 represents a variation on the enclosure of FIG. 2, adding a waveguide 38 extending forward from the planar transducers 16, 18 and 20, and adding phase wedges 40 projecting forward from the planars into the waveguide volume.

Figure 4:
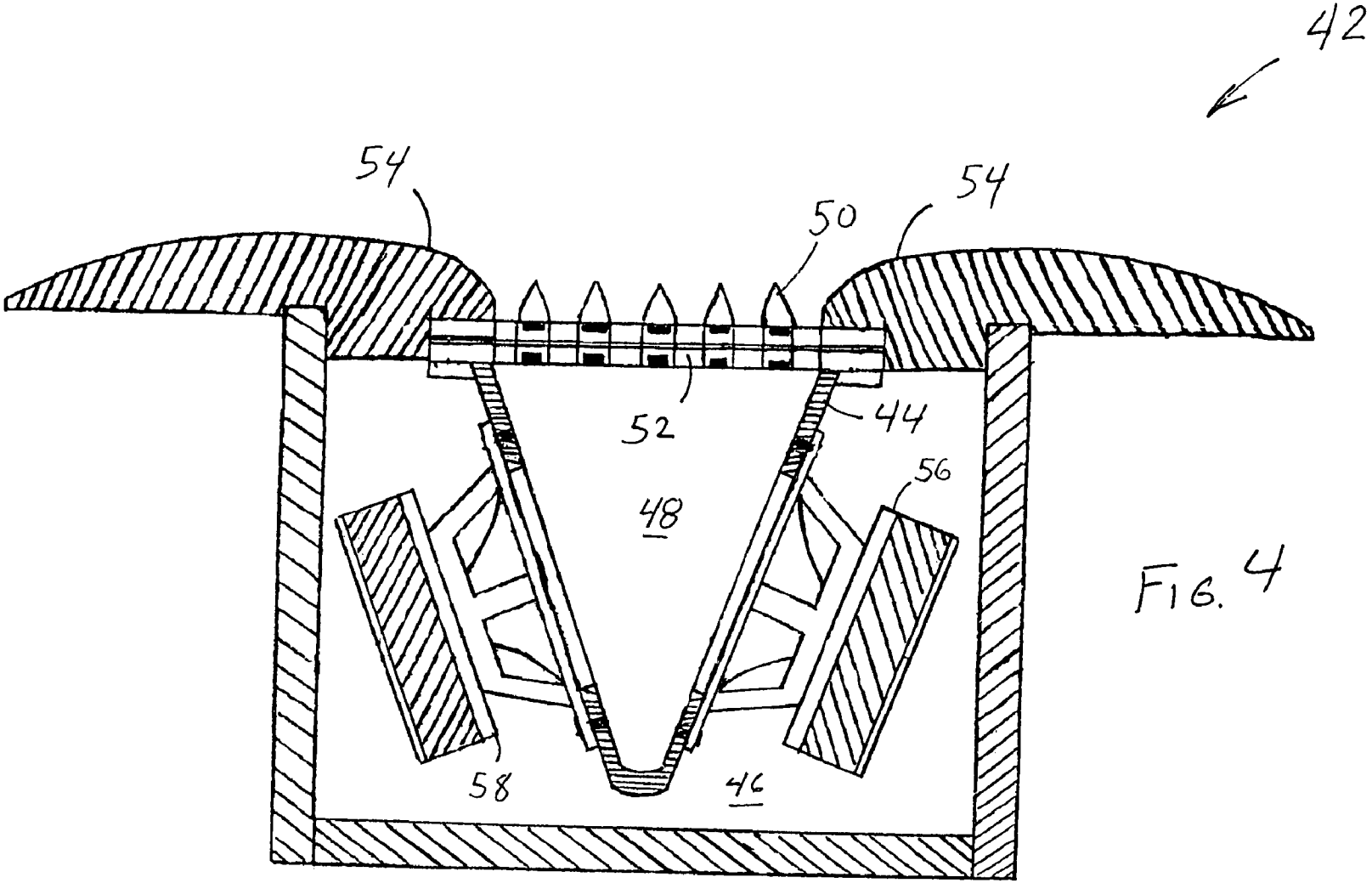
FIG. 4 is a cross sectional view of a third embodiment of the invention.

FIG. 4 illustrates an embodiment replacing the three planar arrangement of FIGS. 1-3 with a single planar 52 disposed over a common chamber 48. Planar 52 is bounded along its edges by a rounded, smooth border 54 which operates to prevent distortion associated with placing sharp borders adjacent a sound radiating surface. Phase wedges 50 are set projecting in the forward radiating direction from diaphragm 52. As before conventional cone loudspeakers 56, 58 are mounted on an internal V-shaped baffle 44 which divides enclosure 42 into the front, common chamber 48 and a rear sealed chamber 46.

Figure 5:
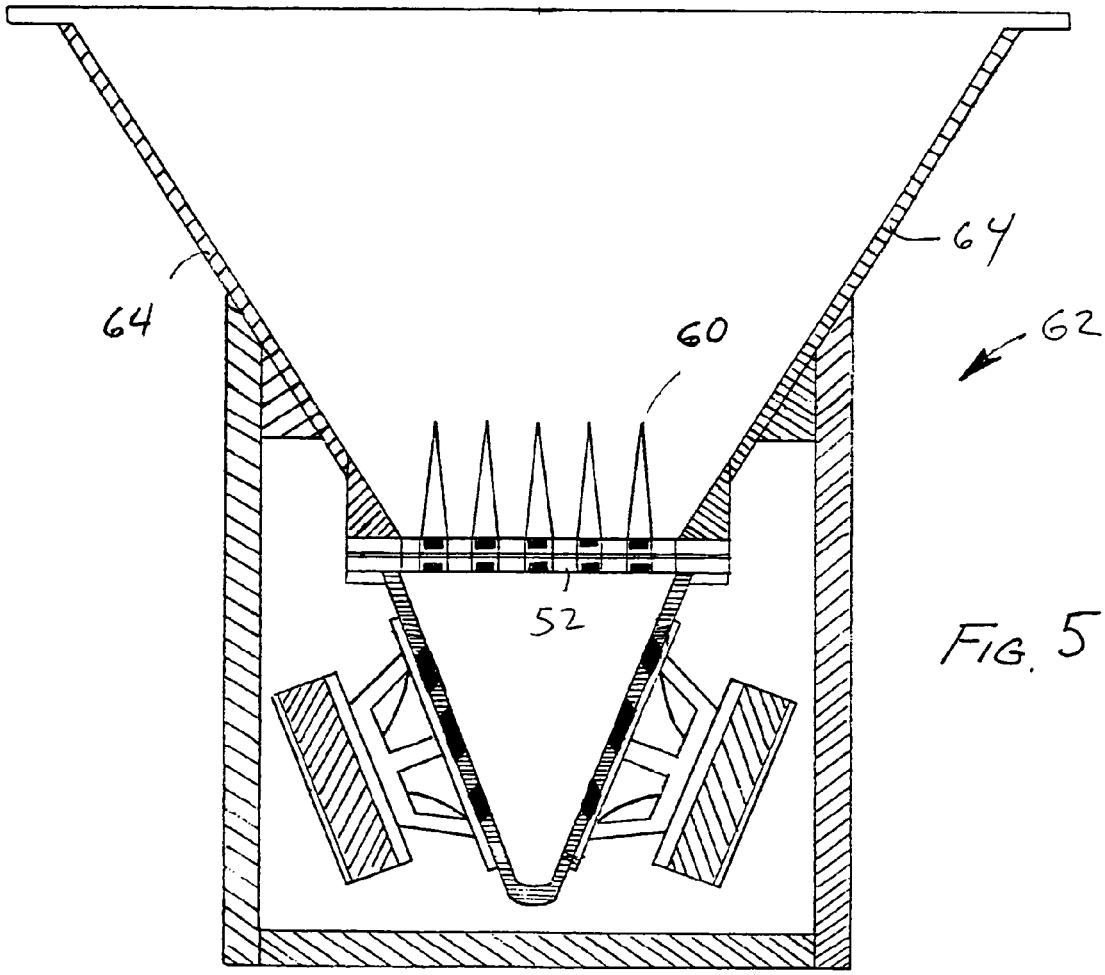
FIG. 5 is a cross sectional view of a fourth embodiment of the invention.

FIG. 5 illustrates an enclosure 62 which is a variation on enclosure 42, adding a waveguide 64 in place of the front face of the enclosure and lengthened the phase wedges 60.

Figure 6:
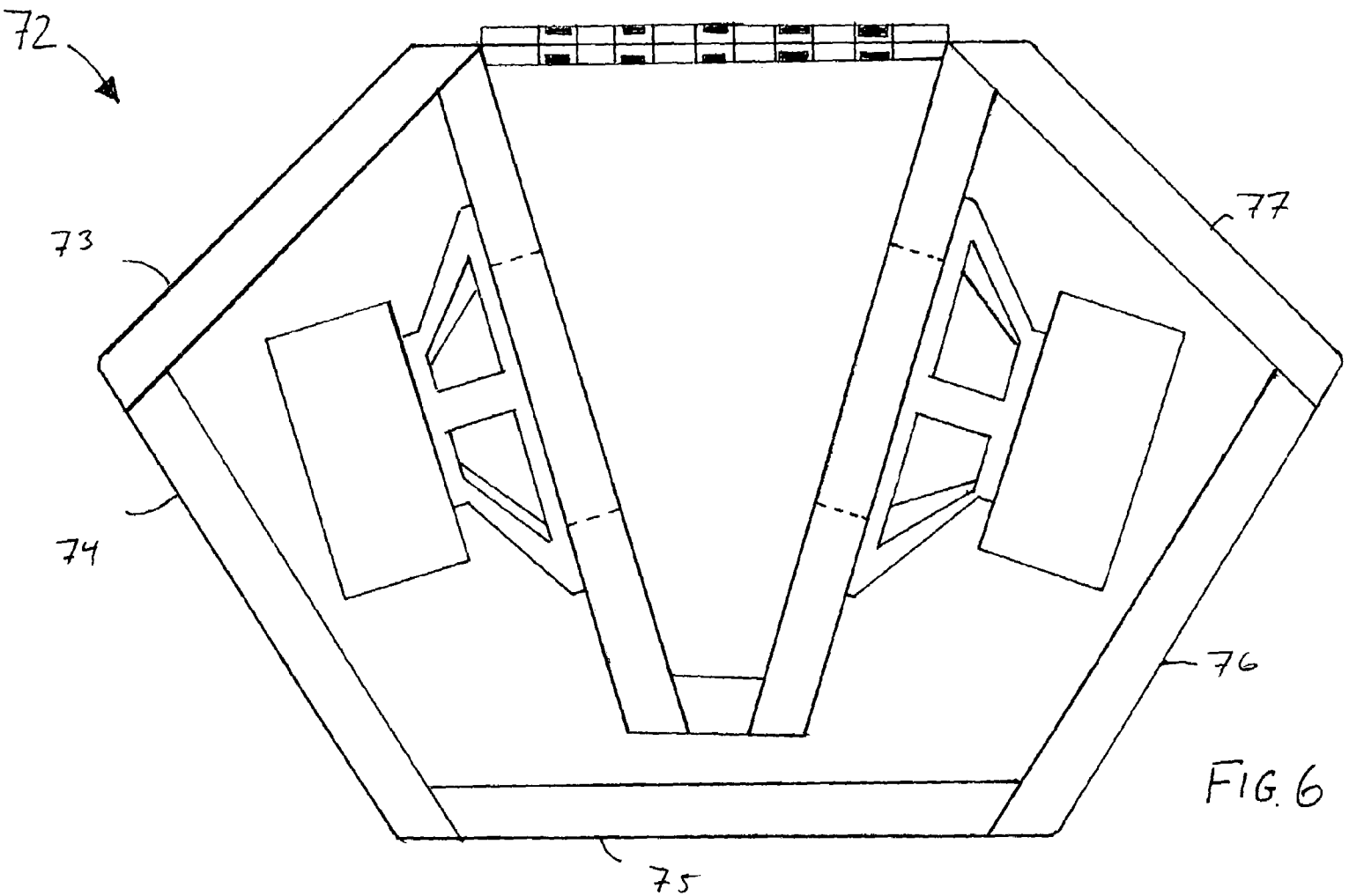
FIG. 6 is a cross sectional view of a fifth embodiment of the invention.

Referring to FIG. 6 an embodiment of an enclosure 72 providing improved standing wave cancellation is illustrated. Not only are surfaces obliquely oriented with respect to nearby transducer major surfaces, but adjacent pairs of walls 73, 74, 75, 76, 77 of the enclosure meet at oblique angles to more effectively kill standing wave generation. Otherwise the arrangement is similar to that of FIG. 2.

Referring to FIG. 7 a schematic for a signal processing circuit 80 is illustrated. An analog input signal received on input 82 is converted there to a digital signal allowing realization of the circuit with digital devices. Next in line is a high pass digital filter 84 set at lowest useable frequency for a given application. The output of the high pass filter 84 passes to a 2-way crossover module 86 that splits the signal between high frequency components and low frequency components. The 2-way crossover module is realized using a 24 dB per octave Linkwitz-Riley filter set at the desired crossover frequency, usually 275 hz. The low frequency signal components are passed to circuit path 88 for further processing and the high frequency components are passed to circuit path 90 for processing.

Each circuit path 88, 90 provides a phase filter 92, 102 to adjust the signals for linear phase angle matching of the high frequency and low frequency components at the crossover point. Next in each path is a set of parametric equalization filters 94, 104 to linearize the frequency response of each segment. Next are delay elements 96, 106 that match the acoustic arrival of the low frequency pressure wavefront to the back of the planar device to coincide with the acoustic output of the planar. Finally each path provides a dynamic compression/limiting element 98, 108 to limit output to a pre-set maximum level to protect the devices. Lastly, the outputs are applied to digital to analog conversion at outputs 100, 110. The signals may then be applied to conventional output stage amplifier channels appropriate for the load represented by the transducers.

Figure 8:
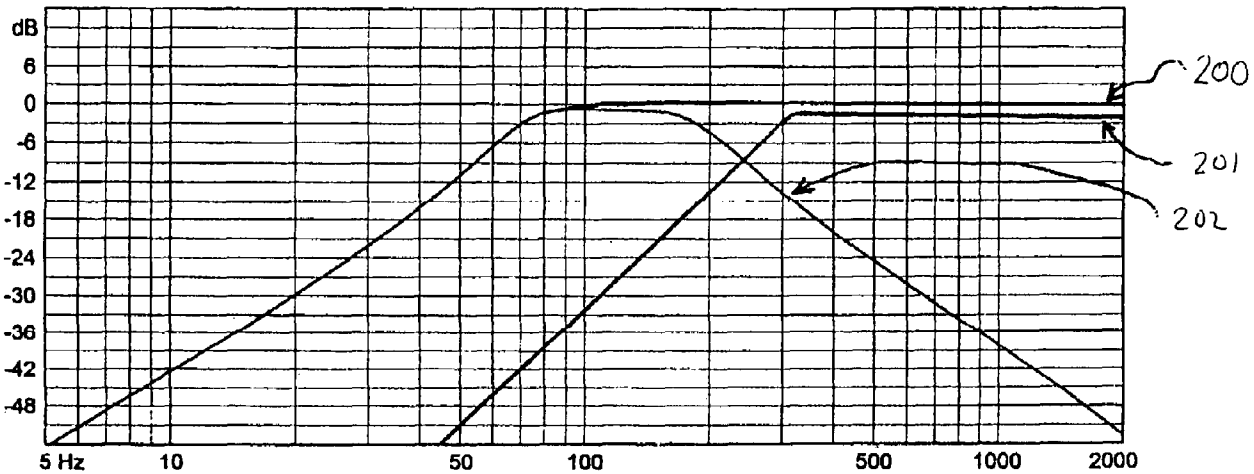
FIGS. 8-12 are a series of graphs illustrating performance of representative embodiments of the invention.
Figure 9:
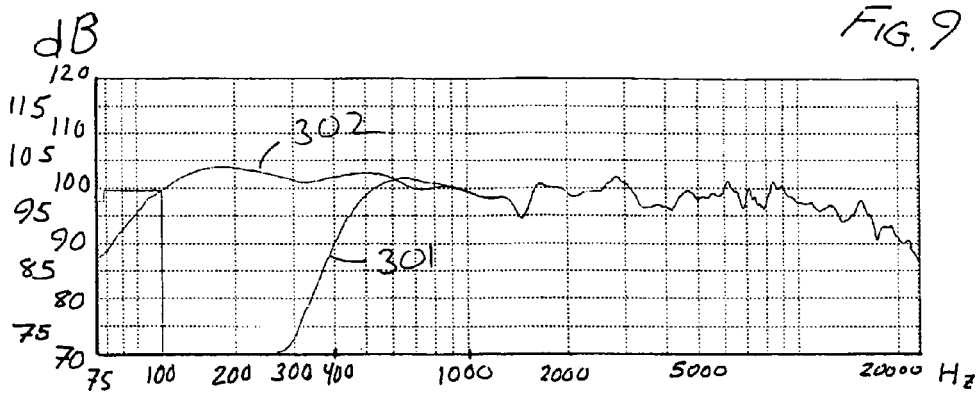

Ideally the output of the device should have a highly linear frequency response. FIG. 8 illustrates the objective where curve 200 represents the summed relationship of the outputs of the low and high frequency channels. FIGS. 9-12 represent empirical evaluation of a representative device. The graph of FIG. 9 is a frequency response overlay comparing operation of a planar device alone (curve 301) compared with operation of the same planar incorporated into a system with symbiotic rear bandpass support (curve 302). Signal fall off is more than two octaves deeper with the planar incorporated into an enclosure and system of the invention.

Figure 10:
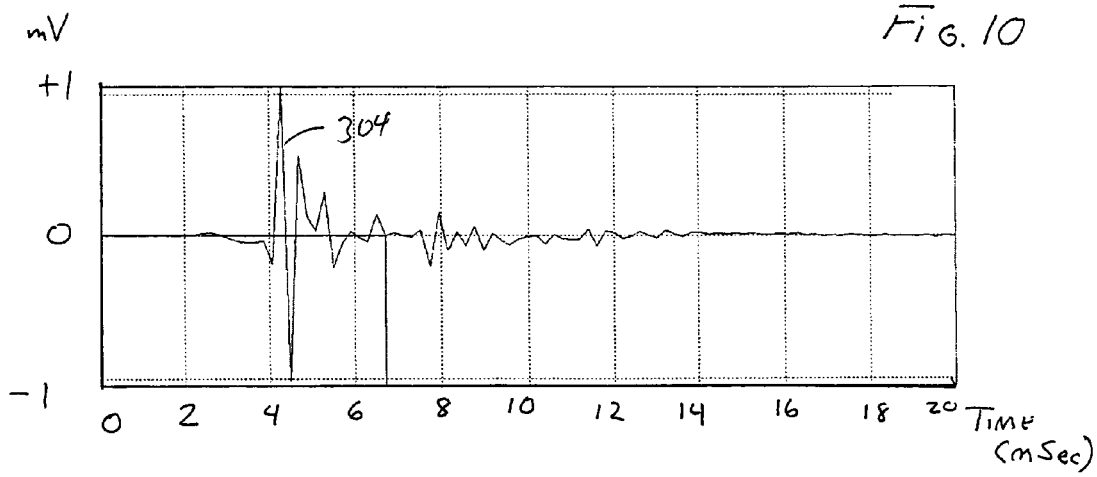

The graph of FIG. 10 is an impulse response curve 304 achieved using cones to drive planars in passive mode and showing excellent transient response and reduced spectral decay distortions than typical of medium mass cones in conventional usage. These responses are representative of the high dampening effect the tensioned diaphragm of the planar has on the acoustic wavefront of the cones as is produced by the vertical arrays of cones and meets at the rear of the tensioned planar diaphragms.

Figure 11:
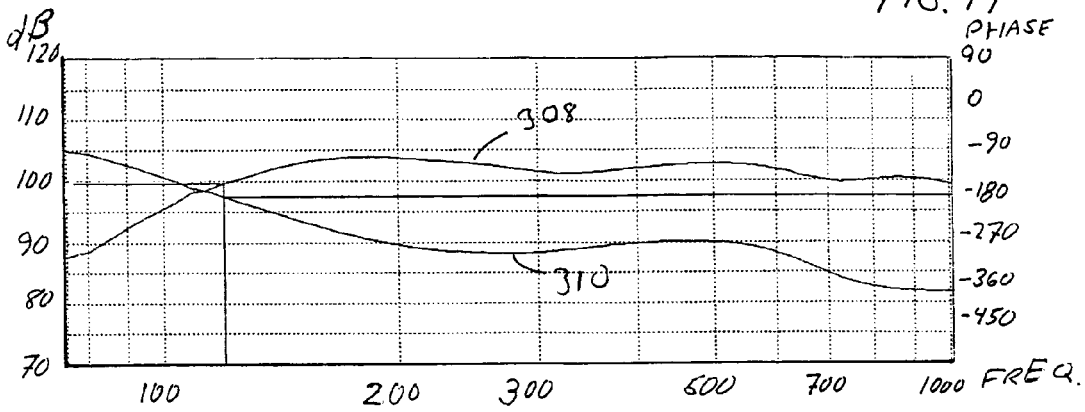

The graph of FIG. 11 illustrates frequency and phase response curves 308, 310 in the cross over range illustrating a very linear phase response curve 310 and demonstrating the close acoustical coupling of the symbiotic arrangement.

Figure 12:
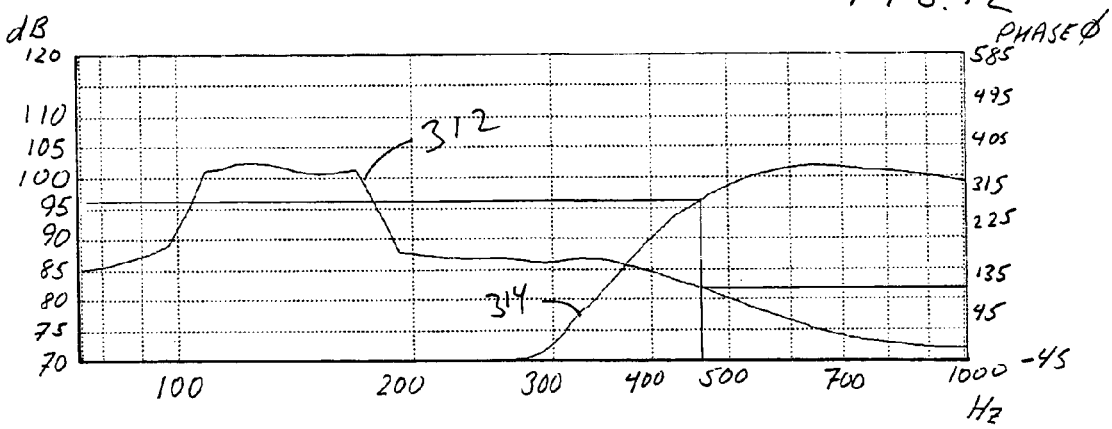

The graph of FIG. 12 is for comparison to that of FIG. 11 and shows the results 312, 314 obtained when the drivers for the symbiotic rear chambers of the devices are turned off. The phase response curve is 312.

The invention provides a system loudspeaker which exploits and then extends the range of its high frequency component to produce a system of reduced weight and size compared with other systems exhibiting comparable performance.

While the invention is shown in only a few of its forms, it is not thus limited but is susceptible to various changes and modifications without departing from the spirit and scope of the invention.

What is claimed is:

1. A speaker system comprising:

an enclosure defining an interior space;

an internal baffle arrangement disposed in the interior space to divide the interior space into a front common-chamber and a rear chamber;

first and second active transducers mounted to the internal baffle arrangement in an orientation to radiate sound energy into the front common-chamber and rear chamber, the first and second active transducers providing for generating sound energy predominantly in a low frequency range; and a planar based acoustic radiator mounted to the enclosure adjacent the front chamber, the planar based acoustic radiator being disposed at an oblique angle relative to the first and second active transducers and coupling low frequency sound from the first and second active transducers to outside the enclosure, the planar based acoustic radiator further incorporating a transducer providing for generating sound energy in a frequency range above the low frequency range of the first and second active transducers.

2. A speaker system as set forth in claim 1, further comprising:

the internal baffle arrangement providing a V-shaped indent behind the planar type transducer to orient the first and second active transducers relative to the planar based acoustic radiator to cancel standing wave generation and to support the first and second transducers for unitary summation of the acoustic output of the pair of active transducers to generate a coherent wavefront.

3. A speaker system as set forth in claim 2, further comprising:

interior surfaces forming the rear chamber being set at oblique angles relative to back surfaces of the first and second active transducers to cancel standing wave generation.

4. A speaker system as set forth in claim 3, further comprising:

electronic excitation circuitry for the first and second active transducers and the planar based acoustic radiator.

5. A speaker system as set forth in claim 4, further comprising:

the rear chamber having a volume ratio relative to the front common-chamber of about 2.75 to 1 where a nominal frequency cross over point between the first and second active transducers and the planar based acoustic radiator is about 275 Hz.

6. A speaker system as set forth in claim 3, further comprising:

the planar based acoustic radiator being horn-loaded.

7. A loudspeaker system comprising:

a sealed multi-chamber enclosure;

a low frequency loudspeaker mounted between first and second chambers of the multi-chamber enclosure to radiate sound energy into the first and second chambers;

a planar radiator mounted on an exterior of the sealed multi-chamber to acoustically couple sound energy from the first chamber to the environment, the radiator having an active operating range at higher frequencies than the low frequency loudspeaker; and the planar radiator being disposed obliquely relative to the low frequency loud speaker.

8. A loudspeaker system as set forth in claim 7, further comprising:

an even numbered plurality of low frequency loudspeakers, the low frequency loud speakers being arranged as partially opposed pairs so that sound energy from the speakers sums to form coherent wavefronts in the first chamber with the wavefronts impinging on the planar radiator.

9. A loudspeaker system as set forth in claim 8, further comprising:

an internal barrier dividing the enclosure into at least the first and second chambers, the internal barrier being set in a V behind the planar transducer to kill development of standing waves.

10. A loudspeaker system as set forth in claim 9, further comprising:

internal surfaces of the second chamber being oriented relative to the low frequency loudspeakers to kill generation of standing waves.

11. A loudspeaker system as set forth in claim 10, further comprising:

electronic excitation circuitry for the low frequency loudspeakers and the planar radiator, the electronic circuitry including filters for acoustically timing, phase matching and equalizing acoustic outputs.

12. A loudspeaker system as set forth in claim 10, further comprising:

the planar radiator being horn loaded.

13. A loudspeaker system as set forth in claim 10, further comprising:

the second chamber having a volume about 2.75 times larger than a volume for the first chamber at a nominal frequency cross over point of about 275 Hz.

* * * * *